US008220650B2

(12) United States Patent
Smith et al.

(10) Patent No.: US 8,220,650 B2
(45) Date of Patent: Jul. 17, 2012

(54) DISPENSING CAPS FOR LIQUID CONTAINERS

(75) Inventors: Matthew Eric Smith, Isle of Man (GB); Karl Mondszein, Nottinghamshire (GB)

(73) Assignee: Carbonite Corporation, Panama City (PA)

( * ) Notice: Subject to any disclaimer, the term of this patent is extended or adjusted under 35 U.S.C. 154(b) by 1084 days.

(21) Appl. No.: 12/091,335

(22) PCT Filed: Oct. 25, 2006

(86) PCT No.: PCT/GB2006/003985

§ 371 (c)(1), (2), (4) Date: May 29, 2008

(87) PCT Pub. No.: WO2007/049045

PCT Pub. Date: May 3, 2007

(65) Prior Publication Data

US 2008/0283485 A1 Nov. 20, 2008

(30) Foreign Application Priority Data

Oct. 27, 2005 (GB) ..... 0521930.8

(51) Int. Cl.
*B65D 51/16* (2006.01)

(52) U.S. Cl. ..... 215/311; 222/501; 222/498

(58) Field of Classification Search ..... 215/311, 215/252, 316, 237, 305, 355, 224, 228, 11.1, 215/11.4, 387, 388; 220/523, 825, 721, 200, 220/810, 203.13, 203.24, 259.5, 360, 501, 220/528, 345.3, 345.2, 350, 345.4, 254.9, 220/254.1; 401/195; 426/112; 206/222, 206/219, 221, 213.1; 264/328.2; 222/518, 222/507, 559, 544, 409, 496, 495, 509
See application file for complete search history.

(56) References Cited

U.S. PATENT DOCUMENTS 2,643,394 A * 6/1953 Wood ..... 4/287
2,829,380 A * 4/1958 Wood ..... 4/287

(Continued)

FOREIGN PATENT DOCUMENTS

DE 85 18 074 2/1986

(Continued)

*Primary Examiner* — Anthony Stashick
*Assistant Examiner* — Kevin Castillo
(74) *Attorney, Agent, or Firm* — Lowe Hauptman Ham & Berner, LLP

(57) ABSTRACT

A drinking cap constitutes a one-piece molding of polymeric material including a first circular section tubular portion (2) for connection to the mouth of a beverage container and a second smaller circular section tubular portion (6) situated at least partially within the first tubular portion. The first tubular portion is connected to the second tubular portion by a resilient, annular, integral web (4), in which one or more flow openings (18) are formed. One end of the second tubular portion (6) is closed. The upper or external surface of the web (4) carries a projecting annular first sealing flange (20) at a point intermediate its ends, as seen in axial sectional view. The first and second tubular portion (2, 6) are coaxial and relatively movable in the axial direction between an open position, in which the flow openings (18) are unobstructed, and a closed position, in which the sealing flange (20) is in sealing engagement with the internal surface of the first tubular portion (2). The flow openings (18) are thus prevented from communicating with the atmosphere. When the cap is in the closed position, the free edge of the first sealing flange (20) forms a substantially line seal with the internal surface of the first tubular portion (2).

21 Claims, 1 Drawing Sheet

U.S. PATENT DOCUMENTS

| | | | | |
|---|---|---|---|---|
| 3,337,900 | A * | 8/1967 | Schwartzman | 401/206 |
| 5,509,433 | A * | 4/1996 | Paradis | 137/1 |
| 5,597,096 | A | 1/1997 | Jeppesen et al. | |
| 5,620,114 | A * | 4/1997 | Chalfa, Jr. | 222/23 |
| 5,680,965 | A * | 10/1997 | Beck | 222/153.06 |
| 5,931,350 | A * | 8/1999 | Heilman | 222/153.14 |
| 6,158,197 | A * | 12/2000 | Mogard et al. | 53/410 |
| 6,213,351 | B1 * | 4/2001 | Stoneberg et al. | 222/153.14 |
| 6,250,503 | B1 * | 6/2001 | Dark | 222/1 |
| 6,267,269 | B1 * | 7/2001 | Kates | 222/162 |
| 6,378,742 | B1 * | 4/2002 | Rohr et al. | 222/494 |
| 6,629,624 | B2 * | 10/2003 | Stillinger et al. | 220/714 |
| 6,749,092 | B2 * | 6/2004 | Olechowski et al. | 222/514 |
| 6,834,782 | B2 * | 12/2004 | Ritter | 222/521 |
| 6,938,794 | B2 * | 9/2005 | Elder | 220/714 |
| 6,938,836 | B2 * | 9/2005 | Bouic | 239/346 |
| 6,971,550 | B2 * | 12/2005 | Kuge et al. | 222/105 |
| 6,976,669 | B2 * | 12/2005 | Van Zijll Langhout et al. | 251/342 |
| 7,299,939 | B2 * | 11/2007 | Ver Hage | 222/388 |
| 7,320,410 | B2 * | 1/2008 | Ver Hage | 222/388 |
| 7,418,998 | B2 * | 9/2008 | Aoki et al. | 165/104.33 |
| 7,478,442 | B2 * | 1/2009 | King | 4/498 |
| 7,735,699 | B2 * | 6/2010 | Brannon et al. | 222/547 |
| 2005/0087571 | A1 * | 4/2005 | Dark | 222/544 |
| 2007/0062905 | A1 * | 3/2007 | Hung | 215/311 |

FOREIGN PATENT DOCUMENTS

| | | | |
|---|---|---|---|
| DE | 3522227 | A * | 1/1987 |
| EP | 0 580 883 | | 2/1994 |
| WO | WO 94/14588 | | 7/1994 |

* cited by examiner

DISPENSING CAPS FOR LIQUID CONTAINERS

CROSS-REFERENCE TO RELATED APPLICATIONS

The present Application is based on International Application No. PCT/GB2006/003985, filed on Oct. 25, 2006, which in turn corresponds to Great Britain Application No. 0521930.8, filed on Oct. 27, 2005, and priority is hereby claimed under 35 USC §119 based on these applications. Each of these applications are hereby incorporated by reference in their entirety into the present application.

FIELD OF THE INVENTION

The present invention relates to dispensing caps for liquid bottles or other containers. The invention is particularly concerned with drinking caps for beverage containers, particularly containers for carbonated beverages, but relates also to dispensing caps for containers for liquids such as detergent or flowable foodstuffs.

BACKGROUND OF THE INVENTION

Dispensing caps typically include two moulded plastic components which are connected together and are relatively movable between a first position, in which the bottle, to which the cap is connected, is sealed and a second position, in which the interior of the bottle communicates with the exterior through one or more openings through which a liquid in the bottle may flow. Such caps thus provide a resealing facility and, in the case of a drinking cap, the ability to drink from the bottle without removing the cap. However, the two separate components must be moulded separately and then connected together. This is both time-consuming and expensive.

One-piece dispensing caps are known and DE-G-8518074.2 discloses such a cap of the type including a first circular section tubular portion with a first radius for connection to the mouth of a container and a second circular section tubular portion with a second radius smaller than the first radius, the first tubular portion being connected to the second tubular portion by a resilient, annular, integral web, in which one or more flow openings are formed, the width of the web being equal to or greater than the difference between the first and second radii, one end of the second tubular portion being closed, one of the web and the internal surface of the first tubular portion being connected to a projecting annular first sealing flange, the first and second tubular portions being coaxial and relatively movable in the axial direction between an open position, in which the flow openings are unobstructed, and a closed position, in which and the sealing flange is in sealing engagement with the other of the web and the internal surface of the first tubular portion, whereby the flow openings are prevented from communicating with the atmosphere by the sealing engagement of the first sealing flange with the other of the web and the internal surface of the first tubular portion. However, the cap disclosed in this document is for dispensing powdery solid materials and not liquids and would be inherently unsuitable for use on a liquid container because it is incapable of forming a reliable liquid seal. Thus when the cap is in the closed configuration, the sealing flange and the web are in surface contact. Such surface contact is incapable of providing a reliable seal because the contact force is inherently very low and exerted over a substantial area, whereby the contact pressure is extremely small. As a matter of practice, it is impossible to form the two engaging surfaces completely smooth and complementary and the resulting inevitable gaps will mean that any liquid in the container will be subject to leakage.

SUMMARY OF THE INVENTION

It is the object of the invention to provide a one-piece dispensing cap of the type referred to above and disclosed in the prior document which is suitable for use with liquid containers, particularly containers for carbonated beverages, and will form a reliable seal, when in the closed position.

According to the present invention, a dispensing cap of the type referred to above for use with liquid containers is characterised in that the first sealing flange is integrally connected to the external surface of the web at a point intermediate its ends, as seen in axial sectional view, or to the internal surface of the first tubular portion whereby, when the cap is in the closed position, the free edge of the first sealing flange forms a substantially line seal with the internal surface of the first tubular portion or the external surface of the web. The features in accordance with the invention inherently mean that, when the cap is in the closed position, the web and the sealing flange are not in flat surface contact but instead the free edge of the sealing flange is in line contact with the internal surface of the first tubular portion. The fact that this contact is inherently a line contact means firstly that the contact pressure is very much higher than in the prior document and secondly, partly as a result of the higher pressure, that problems resulting from surface irregularities are eliminated. A reliable liquid seal is thus created.

Thus the dispensing cap in accordance with the invention includes two circular section tubular portions of different radius, one end of each of which is connected by a resilient web whose width, that is to say length in the generally radial direction, will be greater than the difference between the two radii in order to provide the necessary relative movability of the two tubular portions. The tubular portion of greater radius is adapted for connection to the mouth of a bottle or the like whilst the other end of the tubular portion of lesser radius is closed. The resilient web has at least one and preferably a number of spaced flow openings formed in it. The web carries a sealing flange connected to its upper or external surface at a point intermediate its ends, as seen in axial sectional view. The tubular portion of lesser diameter is thus movable in the axial direction with respect to the other tubular portion between an open position, in which the flow openings are unobstructed, and a closed position, in which the sealing flange is in sealing engagement with the internal surface of the tubular portion of greater diameter, thereby sealing the flow openings from the interior of the tubular portions. This means that the container to which the drinking cap is connected is also sealed and thus that no liquid may leave it.

It will be appreciated that when the two tubular portions are in the open position and a force is applied to the tubular portion of smaller diameter to move it into the closed position, the initial movement of the tubular portion of the smaller diameter will necessarily result in compression and/or deformation of the web due to the fact that its length is necessarily greater than the distance between the two tubular portions. This compression and/or deformation will result in the web exerting a restoring force on the tubular portion of lesser diameter urging it back towards the open position. However, as the closing force continues to be exerted, the tubular portion of smaller diameter will move progressively in the axial direction towards the closed position. As it passes through the position in which the web extends substantially in the radial direction, the force exerted by the web on the tubular portion of smaller diameter will act on it to urge it towards the closed position. The tubular portion of smaller diameter is thus effectively bistable and if no external force is applied to it it will automatically move to either the open or the closed position. The sealing flange is positioned and dimensioned such that it is moved into sealing contact with the opposing surface on the internal surface of the tubular portion of larger diameter before the web has reached the fully relaxed position. This means that, in the closed position, the sealing flange is biased into contact with the opposing surface and forms a constant substantially line seal with it. The fact that the sealing flange is on the external surface of the web means that if there should be a superatmospheric pressure within the container, e.g. as the result of the liberation of carbon dioxide from a carbonated beverage, its pressure will act to increase the pressure with which the sealing flange contacts the first tubular portion and will thus increase the integrity of the seal.

It is preferred that the first sealing flange projects from the web in a direction substantially parallel to the axis of the first and second tubular portions, when they are in the open position. This is particularly convenient because it enables the dispensing cap to be readily removed from an injection mould at the end of the injection moulding process in the axial direction. It is also convenient because the web, and thus the first sealing flange integral with it, will typically rotate through about 90° when moving from the open to the closed position, which means that if the first sealing flange extends in the axial direction, when the cap is in the open position, it will extend in the generally radial direction, when the cap is in the closed position, which will mean that its free edge will form a substantially line seal with the opposing surface.

Whilst the first sealing flange may form a seal directly with the internal surface of the tubular portion of greater diameter, it is preferred that the internal surface of the first tubular portion carries a resilient annular second sealing flange, which projects at an acute angle to the axis of the first of the first and second tubular portions and is positioned so that it is sealingly engaged by the first sealing flange, when the first and second tubular portions are in the closed position. This second sealing flange will be caused to yield somewhat in the generally radial direction by the engagement of the first sealing flange and this is found to result in a further enhancement of the sealing integrity.

The first sealing flange may be in the form of a simple laminar strip with a single free end which forms a seal with the internal surface of the first tubular portion. However, it may also be bifurcated, in axial sectional view, and thus have two free ends, both of which engage the internal surface of the first tubular portion in the closed position, and form a line seal with it. This yet further enhances the integrity of the seal.

In order to permit the user readily to grasp the tubular portion of smaller diameter to move it from the open position to the closed position, it is preferred that the first tubular portion carries a radially projecting annular projection.

In order to minimise the risk that the tubular portion of greater diameter might be deformed by physical engagement, when in the closed position, thereby breaking the seal, it is preferred that the first tubular portion may carry an external annular stiffening or reinforcing bead adjacent its connection with the web. This stiffening bead will resist deformation forces and thus minimise the risk of inadvertent leakage occurring.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious aspects, all without departing from the invention. Accordingly, the drawings and description thereof are to be regarded as illustrative in nature, and not as restrictive.

BRIEF DESCRIPTION OF THE DRAWINGS

Further features and details of the invention will be apparent from the following description of two specific embodiments of drinking cap in accordance with the invention, which is given by way of example only with reference to the accompanying drawings, in which.

DETAILED DESCRIPTION OF THE DRAWINGS

Figure 1:
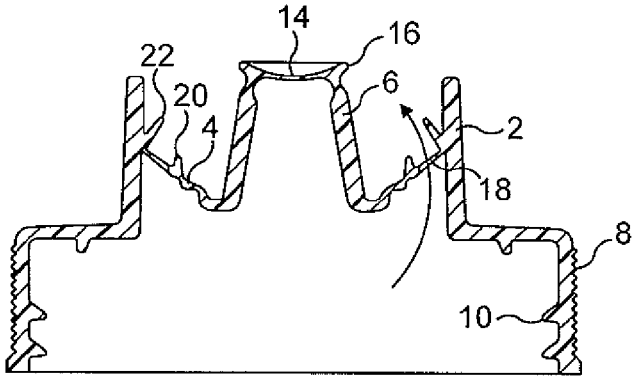
FIG. 1 is an axial sectional view of one embodiment of the drinking cap, when open.
Figure 2:
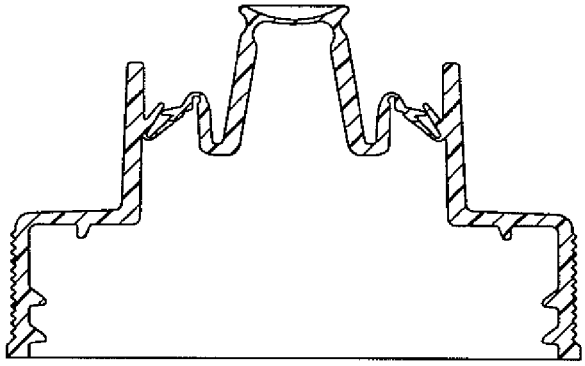
FIG. 2 is an axial sectional view of the drinking cap, when closed.

The drinking cap shown in FIGS. 1 and 2 is a one-piece injection moulded component of polymeric material, such as polypropylene, and comprises a first circular section tubular portion 2 of relatively large diameter, which is integrally connected at a position between its ends by a resilient, flexible web 4 to one end of a second circular section tubular portion 6 of relatively smaller diameter. As may be seen, the tubular portion 6 is of progressively increasing diameter in the downward direction.

The larger tubular portion 2 is adapted to be connected to the neck of a bottle. For this purpose, its diameter may be substantially the same as that of the neck of the bottle to which it is to be connected or, as in this case, it may be integral with a circular section connector portion 8 of yet greater diameter, that is to say with an internal diameter substantially equal to the external diameter of the neck of the bottle. The connector portion 8 may be connected to the bottle in any convenient manner but in the present case it is provided with internal screw threads 10 for cooperation with corresponding screw threads on the exterior of the neck of the bottle. The upper end of the smaller diameter tubular portion 6 is closed by an integral lid 14, the diameter of which is slightly greater than that of the upper end of the tubular portion 6, whereby its radially outer edge constitutes a projecting flange or lip 16, which may be grasped by the user.

As may be seen in FIG. 1, a plurality of holes 18 is formed in the resilient web 4. The width of the resilient web 4, that is to say its length between the lower end of the tubular portion 6 and the tubular portion 2, is greater than the difference between the radii of the two tubular portions. Integral with the upper or external surface of the web 4, at a point intermediate its ends, when seen in axial section, is a first annular sealing flange 20, which extends substantially in the axial direction, when the cap is in the open position illustrated in FIG. 1. Integral with the internal surface of the upper end of the larger tubular portion 2 is a second resilient sealing flange 22, which extends both upwardly, that is to say towards the lid 14, and inwardly towards the axis of the cap, whereby it subtends an acute angle with the axial direction of the cap.

When the cap is in the open position shown in FIG. 1, the tubular portion 6 is located substantially within the tubular portion 2. The web 4 extends downwardly from the tubular portion 2 and also inwardly in the axial direction and the flow openings 18 communicate with the interior of the cap, whereby liquid in the container to which the cap is connected can flow out through the openings 18. A user can readily drink a beverage from the bottle by placing his lips around the outer surface of the tubular portion 2, which will act in the manner of a drinking spout. If an upward force is exerted on the cap 14, the tubular portion 6 begins to move upwardly. This results in compression and distortion of the web 4, which thus exerts a restoring force on the tubular portion 6 urging it back towards the fully open position. As the force continues to be exerted on the cap 14, the tubular portion 6 moves upwardly until the web 4 extends approximately horizontally, that is to say in the radial direction. As the tubular portion 6 moves through and beyond this "dead centre" position, the force exerted by the web 4 on the tubular portion 6 acts in the upward direction. The tubular portion 6 continues to move upwardly and this is accompanied by continuing rotation of the web 4. This movement continues until the free edge of the sealing flange 20 engages the surface of the resilient sealing flange 22. This occurs before the web 4 is fully relaxed, whereby when the upward force on the cap 14 is removed, the force exerted by the web 4 continues to urge the two sealing flanges into contact and the free edge of the flange 20 makes sealed line contact with the surface of the sealing flange 22. This contact line is situated above the flow openings 18, which means that these flow openings are sealed from the atmosphere. The interior of the bottle is thus sealed and no liquid can flow out through the openings 18. If the beverage is carbonated, as soon as the cap is sealed an internal pressure will build up within the head of the bottle. This pressure will act on the underside of the web 4 and increase the contact pressure between the flanges 20 and 22. This will further enhance the integrity of the seal. If it is desired to reopen the bottle, a downward force is exerted on the cap 14 and the process described above is reversed until the cap is again in the open position illustrated in FIG. 1.

In a modified embodiment, which is not illustrated, the free end of the flange 20 is bifurcated so that it contacts the flange 22 along two continuous lines rather than merely one. This further enhances the integrity of the seal.

Figure 3:
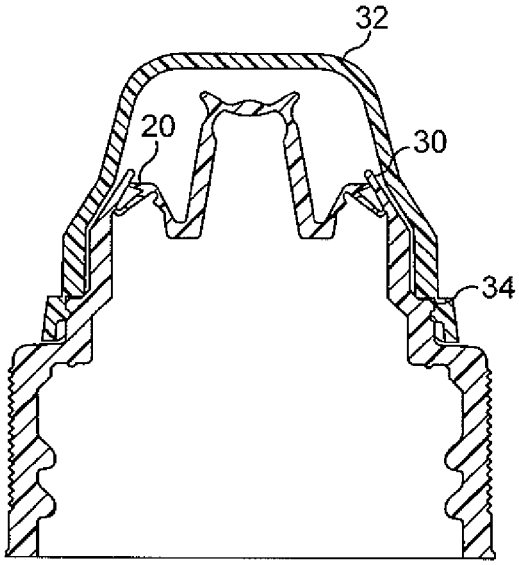
FIG. 3 is a view similar to FIG. 2 of a second embodiment.

The modified embodiment shown in FIG. 3 is very similar to that in FIGS. 1 and 2 and differs from it in only two respects. Firstly, the flange 22 is omitted and the flange 20 on the web 4 engages the internal surface of the tubular portion 2. In this case, the upper portion 30 of the tubular portion 2 is inclined upwardly and inwardly and thus functions in a manner very similar to that of the flange 22. However, this portion 30 need not be so inclined and could merely constitute a portion of the tubular portion 2 which extends parallel to the remainder of the wall of the tubular portion 2. Secondly, the cap is provided with a cap-shaped cover 32 which is provided on its internal surface at its lower end with a formation which cooperates with a complementary formation on the external surface of the tubular portion 2 to constitute a snap or press fit at 34. This cover not only protects the cap from dust, dirt and the like but also protects the cap from being prematurely depressed and thus prevents the bottle from being prematurely or inadvertently opened.

In a further modified embodiment, which is not illustrated, the single sealing flange 20 is connected to the internal surface of the tubular portion 2 and not to the web 4. When the cap is sealed, the free edge of the flange 20 thus forms a line seal with the upper surface of the web 4.

It will be readily seen by one of ordinary skill in the art that the present invention fulfils all of the objects set forth above. After reading the foregoing specification, one of ordinary skill in the art will be able to affect various changes, substitutions of equivalents and various aspects of the invention as broadly disclosed herein. It is therefore intended that the protection granted hereon be limited only by definition contained in the appended claims and equivalents thereof.

The invention claimed is:

1. A drinking cap for a beverage container, comprising:

a one-piece moulding of polymeric material defining the drinking cap and including a first tubular portion adapted to connect to a mouth of the beverage container and having a first circular section, a second tubular portion situated at least partially within the first tubular portion and having a second circular section smaller than the first circular section, and a resilient, annular, integral web connecting the first tubular portion with the second tubular portion, wherein said web includes one or more flow openings, the second tubular portion has one end thereof being closed, said one piece moulding drinking cap further comprises a first sealing annular flange connecting the web and an internal surface of the first tubular portion, the first and second tubular portions are coaxial and relatively movable in an axial direction between an open position, in which the flow openings are unobstructed, and a closed position, in which the first sealing flange is in a sealing engagement with the web and the internal surface of the first tubular portion, whereby the flow openings are prevented from communicating with atmosphere by the sealing engagement of the first sealing flange with the web and the internal surface of the first tubular portion, wherein the first sealing flange is integrally connected to an external surface of the web at a point intermediate its ends, as seen in an axial sectional view, or to the internal surface of the first tubular portion whereby, when the cap is in the closed position, a free edge of the first sealing flange defines a substantially line seal with the internal surface of the first tubular portion or the external surface of the web.

2. The cap as claimed in claim 1, wherein the first sealing flange projects from the web in a direction substantially parallel to the axis direction of the first and second tubular portions in the open position.

3. The cap as claimed in claim 1, further comprising a resilient annular second sealing flange, which projects at an acute angle to the axis of the first and second tubular portions and is positioned in a sealing engagement with the first sealing flange, when the first and second tubular portions are in the closed position.

4. The cap as claimed in claim 1, wherein the first sealing flange is bifurcated, in the axial sectional view, and thus has two free ends, both of which engage the internal surface of the first tubular portion, when in the closed position, and form a line seal.

5. The cap as claimed in claim 1, further comprising a radially projecting annular projection projecting from the closed end of the second tubular portion for engagement by the user to move the second tubular portion relative to the first tubular portion into the closed position.

6. The cap as claimed in claim 1, wherein the second tubular portion is of progressing increasing diameter, at least in the vicinity of the said one end.

7. The cap as claimed in claim 1, wherein said cap is engageable with a removable cover which is configured to connect to the first tubular portion and cover the second tubular portion.

8. The cap as claimed in claim 2, further comprising a resilient annular second sealing flange, which projects at an acute angle to the axis of the first and second tubular portions and is positioned in a sealing engagement with the first sealing flange, when the first and second tubular portions are in the closed position.

9. The cap as claimed in claim 2, wherein the first sealing flange is bifurcated, in an axial sectional view, and thus has two free ends, both of which engage the internal surface of the first tubular portion, when in the closed position, and form a line seal.

10. The cap as claimed in claim 3, wherein the first sealing flange is bifurcated, in an axial sectional view, and thus has two free ends, both of which engage the internal surface of the first tubular portion, when in the closed position, and form a line seal.

11. The cap as claimed in claim 2, further comprising a radially projecting annular projection projecting from the closed end of the second tubular portion for engagement by the user to move the second tubular portion relative to the first tubular portion into the closed position.

12. The cap as claimed in claim 3, further comprising a radially projecting annular projection projecting from the closed end of the second tubular portion for engagement by the user to move the second tubular portion relative to the first tubular portion into the closed position.

13. The cap as claimed in claim 4, further comprising a radially projecting annular projection projecting from the closed end of the second tubular portion for engagement by the user to move the second tubular portion relative to the first tubular portion into the closed position.

14. The cap as claimed in claim 2, wherein the second tubular portion has a progressing increasing diameter, at least in the vicinity of the said one end.

15. The cap as claimed in claim 3, wherein the second tubular portion is of progressing increasing diameter, at least in the vicinity of the said one end.

16. The cap as claimed in claim 4, wherein the second tubular portion is of progressing increasing diameter, at least in the vicinity of the said one end.

17. The cap as claimed in claim 5, wherein the second tubular portion is of progressing increasing diameter, at least in the vicinity of the said one end.

18. The cap as claimed in claim 2, wherein said cap is engageable with a removable cover which is configured to connect to the first tubular portion and cover the second tubular portion.

19. The cap as claimed in claim 3, wherein said cap is engageable with a removable cover which is configured to connect to the first tubular portion and cover the second tubular portion.

20. The cap as claimed in claim 4, wherein said cap is engageable with a removable cover which is configured to connect to the first tubular portion and cover the second tubular portion.

21. The cap as claimed in claim 3, wherein the first sealing flange on the web directly engages the second sealing flange from below in the closed position.

* * * * *